US009404359B2

(12) United States Patent
Fraser

(10) Patent No.: US 9,404,359 B2
(45) Date of Patent: Aug. 2, 2016

(54) ACTIVE DRILLING MEASUREMENT AND CONTROL SYSTEM FOR EXTENDED REACH AND COMPLEX WELLS

(71) Applicant: Saudi Arabian Oil Company, Dhahran (SA)

(72) Inventor: Scott David Fraser, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 655 days.

(21) Appl. No.: 13/734,497

(22) Filed: Jan. 4, 2013

(65) Prior Publication Data

US 2013/0168085 A1 Jul. 4, 2013

Related U.S. Application Data

(60) Provisional application No. 61/583,066, filed on Jan. 4, 2012.

(51) Int. Cl.
*E21B 47/12* (2012.01)
*E21B 21/10* (2006.01)

(52) U.S. Cl.
CPC ..... *E21B 47/12* (2013.01); *E21B 21/103* (2013.01)

(58) Field of Classification Search
CPC ..... E21B 21/103; E21B 47/12
See application file for complete search history.

(56) References Cited

U.S. PATENT DOCUMENTS 2,833,517 A * 5/1958 Bobo ..... 175/69
4,373,582 A * 2/1983 Bednar et al. ..... 166/66.4
5,465,787 A * 11/1995 Roth ..... 166/66.4
6,003,834 A * 12/1999 Read ..... 251/30.01
6,349,763 B1 * 2/2002 Estep et al. ..... 166/66.4
6,401,838 B1 6/2002 Rezmer-Cooper (Continued)

FOREIGN PATENT DOCUMENTS

WO 98/42948 A1 10/1998
WO 2007/021274 A1 2/2007
WO 2008/063072 A1 5/2008

OTHER PUBLICATIONS

C. Cameron, Drilling Fluids Design and Management for Extended Reach Drilling, IADC/SPE Drilling Conference, SPE/IADC Middle East Drilling Technology Conference, Oct. 22-24, 2001, paper No. 72290-MS, Bahrain.

(Continued)

*Primary Examiner* — Robert E Fuller
(74) *Attorney, Agent, or Firm* — Bracewell LLP; Constance G. Rhebergen; Keith R. Derrington

(57) ABSTRACT

A dynamically controlled drill string includes a communications sub, a circulation sub and a measurement sub. The communications sub is operable to receive a wireless signals and retransmit the signals wirelessly. The measurement sub is operable to detect a downhole condition and transmit wirelessly a corresponding data signal. The circulation sub is operable to selectively permit fluid communication between the interior fluid conduit and the exterior of the dynamically controlled drill string at the circulation sub. The circulation sub is operable to selectively permit fluid communication through the internal fluid conduit at the circulation sub. A method for using the dynamically controlled drill string in a well bore includes the steps of introducing the dynamically controlled drill string into the well bore and introducing fluid operable to modify a detected downhole conditions into the well bore.

17 Claims, 4 Drawing Sheets

(56) References Cited

U.S. PATENT DOCUMENTS

| | | | | |
|---|---|---|---|---|
| 6,450,258 | B2 | 9/2002 | Green et al. | |
| 6,959,762 | B2 | 11/2005 | Sask | |
| 6,976,535 | B2 | 12/2005 | Aronstam et al. | |
| 7,059,407 | B2 | 6/2006 | Tolman et al. | |
| 7,114,582 | B2 * | 10/2006 | Eppink et al. | 175/61 |
| 7,172,038 | B2 | 2/2007 | Terry et al. | |
| 7,429,030 | B2 | 9/2008 | Dwivedi | |
| 2004/0065477 | A1 | 4/2004 | Paulk et al. | |
| 2005/0011645 | A1 | 1/2005 | Aronstam et al. | |
| 2008/0029306 | A1 * | 2/2008 | Krueger et al. | 175/210 |
| 2009/0166031 | A1 | 7/2009 | Hernandez | |
| 2009/0272580 | A1 * | 11/2009 | Dolman et al. | 175/48 |
| 2010/0067329 | A1 | 3/2010 | Edwards et al. | |
| 2010/0270034 | A1 | 10/2010 | Clausen | |
| 2011/0061862 | A1 | 3/2011 | Loretz et al. | |
| 2011/0127047 | A1 | 6/2011 | Themig et al. | |
| 2012/0273191 | A1 * | 11/2012 | Schmidt et al. | 166/250.1 |
| 2013/0008648 | A1 * | 1/2013 | Lovorn et al. | 166/250.01 |
| 2013/0269951 | A1 * | 10/2013 | Tahoun et al. | 166/373 |

OTHER PUBLICATIONS

Petersen, Johnny, and Rommetveit, Kick with Lost Circulation Simulator, a Tool for Design of Complex Well Control Situations, Society of Petroleum Engineers Inc., SPE Asia Pacific Oil and Gas Conference and Exhibition, Oct. 12-14, 1998, paper No. 49956-MS, Perth, Australia.

D. Veeningen, Novel High Speed Telemetry System With Measurements Along the String Mitigates Drilling Risk and Improves Drilling Efficiency, Society of Petroleum Engineers, Brasil Offshore, Jun. 14-17, 2011, paper No. 143430-MS, Macae, Brazil.

E. Zegarra, D. Meek, U. Cassee, and J. Leblanc, Intelligent Wireless Orienter for Coiled Tubing Drilling: Development to Filed Test, Society of Petroleum Engineers Inc., SPE/ICoTA Coiled Tubing Conference and Exhibition, Apr. 9-10, 2002, paper No. 74836-MS, Houston, Texas.

J.E. Gravdal and R.J. Lorentzen, Wired Drill Pipe Telemetry Enables Real-Time Evaluation of Kick During Managed Pressure Drilling, Society of Petroleum Engineers, SPE Asia Pacific Oil & Gas Conference and Exhibition, Oct. 18-20, 2010, paper No. 132989-MS, Brisbane, Queensland, Australia.

PCT International Search Report and the Written Opinion of the International Searching Authority dated Jan. 27, 2014; International Application No. PCT/US2013/020288; International File Date: Jan. 4, 2013.

* cited by examiner

ACTIVE DRILLING MEASUREMENT AND CONTROL SYSTEM FOR EXTENDED REACH AND COMPLEX WELLS

CROSS-REFERENCE TO RELATED PATENT APPLICATIONS

This application claims priority from U.S. Provisional Application No. 61/583,066, filed Jan. 4, 2012. For purposes of United States patent practice, this application incorporates the contents of the Provisional Application by reference in its entirety.

BACKGROUND OF THE INVENTION

1. Field of the Invention

The field of invention relates to an apparatus and method of using petroleum-drilling tools on a drill string. More specifically, the field directs to an apparatus and method of using a dynamically controlled drill string in a well bore.

2. Description of the Related Art

In horizontal drilling, there are many challenges to maintaining operations that are not present in vertical or even deviated systems. Gravity pulls the metal drill pipes, drill collars, drill bit and tools against the well bore wall, causing friction while drilling. In extended-reach wells (ERWs), well bore collapses, stress fracturing and breaking of long drill strings, poor fluid circulation along the length of the well bore, and solids accumulation can trap a drill string in a well bore. Halting the rotation of the drill string further exacerbates friction.

When a drill string becomes stuck, increasing drill fluid circulation can sometimes free the string. Increasing the drilling fluid circulation rate provides fluid lift to the drill string and erodes accumulated solids that choke the hole, both suspending and conveying them to the surface. Drilling fluid is introduced from the surface, flows through the internal fluid conduit of the drill string down to the distal end of the drill string, passes from the drill string, and flows back to the surface through the well bore annulus. The well bore annulus is the space between the drill string and the wall of the well bore. Introducing fluid first into the well bore annulus reverses the flow to and from the surface.

Potentially a number of problems exist with simply increasing drilling fluid flow in a horizontal well, especially an ERW to treat a well bore condition. The fluid exiting the end of the drill string has traveled hundreds or thousands of meters—in some cases several kilometers—before passing into the well bore. To address the problem, the fluid then has to travel possibly thousands of more meters in the well bore annulus before encountering the well bore condition. Some ERWs have horizontal runs beyond 35,000 feet. This requires a tremendous amount of energy to reach this problem site, usually in the form of higher fluid pressure. Well bore conditions, including pore pressure and fracture gradient, can severely limit the maximum pressure of the drilling fluid passing from the drill pipe against the face of the distal end of the well bore. Directly applying fluid to or at least introducing it proximate to the problem area may prevent this situation.

Rarely is there any data or information proximate to where the problem occurs in the well bore. If a collapsed portion of the well bore or trapped part of the drill string is uphole from the borehole assembly (BHA), sensors on the BHA are effectively useless. Having sensing nodes along the operative length of the drill string can provide critical downhole condition information. Such information can permit the determination of borehole conditions in situations such that an operator can act to free the trapped drill string in, a timely and safe manner or respond to a process anomaly, including a kick.

During a well bore collapse or a prolonged cessation of fluid flow, solids accumulation may not permit the re-establishment of fluid flow. Traditional mud-pulsing telemetry does not function when fluid flow is not established. Other means of communication not based upon fluid flow technology is useful in situations where there is loss of drill string or well bore control and well bore fluid flow is not consistent or reliable.

SUMMARY OF THE INVENTION

A dynamically controlled drill string has an operative length, an internal fluid conduit that extends within the dynamically controlled drill string along its operative length and an external surface that extends for the operative length. The dynamically controlled drill string has a communications sub that is operable to receive wirelessly a data signal, to retransmit wirelessly the data signal, to receive wirelessly a pre-designated command signal and to retransmit wirelessly the pre-designated command signal. The dynamically controlled drill string also has a measurement sub that is operable to detect a downhole condition, to transmit wirelessly a corresponding data signal associated with the downhole condition and to receive wirelessly the pre-designated command signal. The dynamically controlled drill string also has a circulation sub that is operable to selectively permit fluid communication between the interior fluid conduit and the exterior of the dynamically controlled drill string and to receive wirelessly the pre-designated command signal. The dynamically controlled drill string has an open distal end through which fluids pass between the internal fluid conduit and a well bore.

A method for modifying a detected downhole condition in a well bore using a dynamically controlled drill string includes the step of introducing the dynamically controlled drill string into the well bore. The introduction causes the formation of a well bore annulus between an external surface of the dynamically controlled drill string and a wall of the well bore. The well bore is defined by the well bore wall that extends from a surface into a hydrocarbon-bearing formation. The well bore contains a well bore fluid. The circulation sub of the dynamically controlled drill string is operable to selectively modify a fluid circulation flow path for the well bore fluid upon receiving of a pre-designated command signal. The method includes the step of inducing circulation of the fluid in the well bore such that the fluid circulates through the dynamically controlled drill string and the well bore annulus along a first fluid circulation flow path. The method includes the step of operating the dynamically controlled drill string such that the measurement sub detects a downhole condition and transmits wirelessly upstring a corresponding data signal associated with the detected downhole condition. The method includes the step of operating the dynamically controlled drill string such that the communication sub receives wirelessly the data signal from the measurement sub and retransmits the data signal wirelessly upstring, where the communication sub is located upstring of the measurement sub. The method includes the step of transmitting wirelessly downhole to the circulation sub a pre-designated command signal associated with modifying the fluid circulation flow path from the first fluid circulation flow path to a second fluid circulation flow path, where the second fluid circulation flow path directs fluid towards the detected downhole condition. The method includes the step of operating the dynamically controlled drill string such that the communication sub receives wirelessly the pre-designated command signal from upstring and retransmits the pre-designated command signal wirelessly downstring, where the communication sub is located upstring of the circulation sub. The method includes the step of introducing a modifying fluid that is operable to modify the detected downhole condition into the well bore such that the modifying fluid circulates in the well bore along the second fluid circulation flow path fluid and modifies the detected downhole condition.

Dynamic drill string control is possible using a drill string having at least one measurement sub, at least one communication sub and at least one circulation sub. Transmission of pre-determined command signals can adjust fluid flow not only in the drill string but also in the well bore annulus to mitigate a detected downhole condition or determined borehole condition as quickly as identified.

The measurement sub in the dynamically controlled drill string is operable to provide data periodically or continuously. It is beneficial to have real time updates to downhole and borehole conditions during directional drilling, geosteering, formation evaluation, fluid evaluation, drilling dynamics analysis, propulsion management and upset intervention. Real-time updating of dynamic downhole and borehole conditions is useful for managing drills string operations and maintaining control over the well bore. Other examples of potential beneficial situations involving real-time updated distributed data include reducing the instances of differential sticking of the drill string against the well bore wall by having downhole condition information of the well bore, troubleshooting well bore annulus solids loading, formation breakdowns, formation influx or losses, drill string pipe buckling, weight transfer issues, failure analysis of the drill string, preventing excessive swab-surge during tripping of an embodiment of the dynamically controlled drill string, detecting well bore pressures during leak off tests and detecting conditions indicating kicks or losses while not drilling. For example, tri-axial loading conditions taken simultaneously at several measurement subs can provide input to buckling, weight transfer, shocks, wear, failure mode, torque and drag analysis and monitoring applications as well as Mechanical Specific Energy (MSE) calculations.

Condition detection using more than one measurement sub along the length of the dynamically controlled drill string in conjunction with the ability to selectively induce fluid circulation permits not only improves drill string control but also well bore condition management. Improved hole cleaning, spotting fluids for well bore treatment mid-string, introducing intervention fluids to prevent fluid loss or influx, circulating fluid uphole of a blockage or collapse to maintain well bore control, freeing a trapped drill string due to solids accumulation, monitoring and modifying conditions associated with equivalent circulating density (ECD), investigating swab and surge effects along the operative length of the drill string and mitigating drill string operational issues, including improper drill string position, stuck pipe, pipe buckling and unexpected weight transfer, are all possible with the dynamically controlled drill string.

The dynamically controlled drill string is operable to perform well bore maintenance activities. For example, introduction of the dynamically controlled drill string can position a circulation sub proximate to a location in the well bore in need of treatment. Diverting fluid flow against the well bore wall applies the treatment. Well bore treatments include cement and other substances operable to solidify in the downhole environment to seal the formation or part of the well bore. Well bore treatments also include loss control materials (LCMs), lighter or heavier fluids to control hydrocarbon influx or drilling fluid losses into or out of the formation, lubricants and combinations of acids and enzymes to remove mud cake.

The dynamically controlled drill string is operable to perform hole cleaning and debris removal. Increasing the localized flow rate uphole prevents cuttings and solids buildup, which can clog the well bore annulus. Opening annular flow control valves along the length of the dynamically controlled drill string increases drilling fluid velocity in the well bore annulus without exerting additional fluid pressure at the face of the well bore. In particular, in areas where hole cleaning is difficult or the well bore is physically constricted, diverting fluid flow into those areas can increase local fluid velocity. Selective throttling of flow control valves positioned between the interior of the dynamically controlled drill string and the well bore annulus at several circulation subs in coordination with one another induces changes to the well bore fluid flow in the well bore annulus that removes and dislodges solids. This is especially useful in ERWs, where in the long horizontal sections the solids can become unsuspended and settle in the well bore.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

In the accompanying Figures, similar components or features, or both, may have the same reference label. FIGS. 1 and 2 and their descriptions facilitate a better understanding of the dynamically controlled drill string system and its method of use. In no way should the Figures limit or define the scope of the invention. The Figures are simple diagrams for ease of description.

DETAILED DESCRIPTION OF THE PREFERRED EMBODIMENTS

Figure 1:
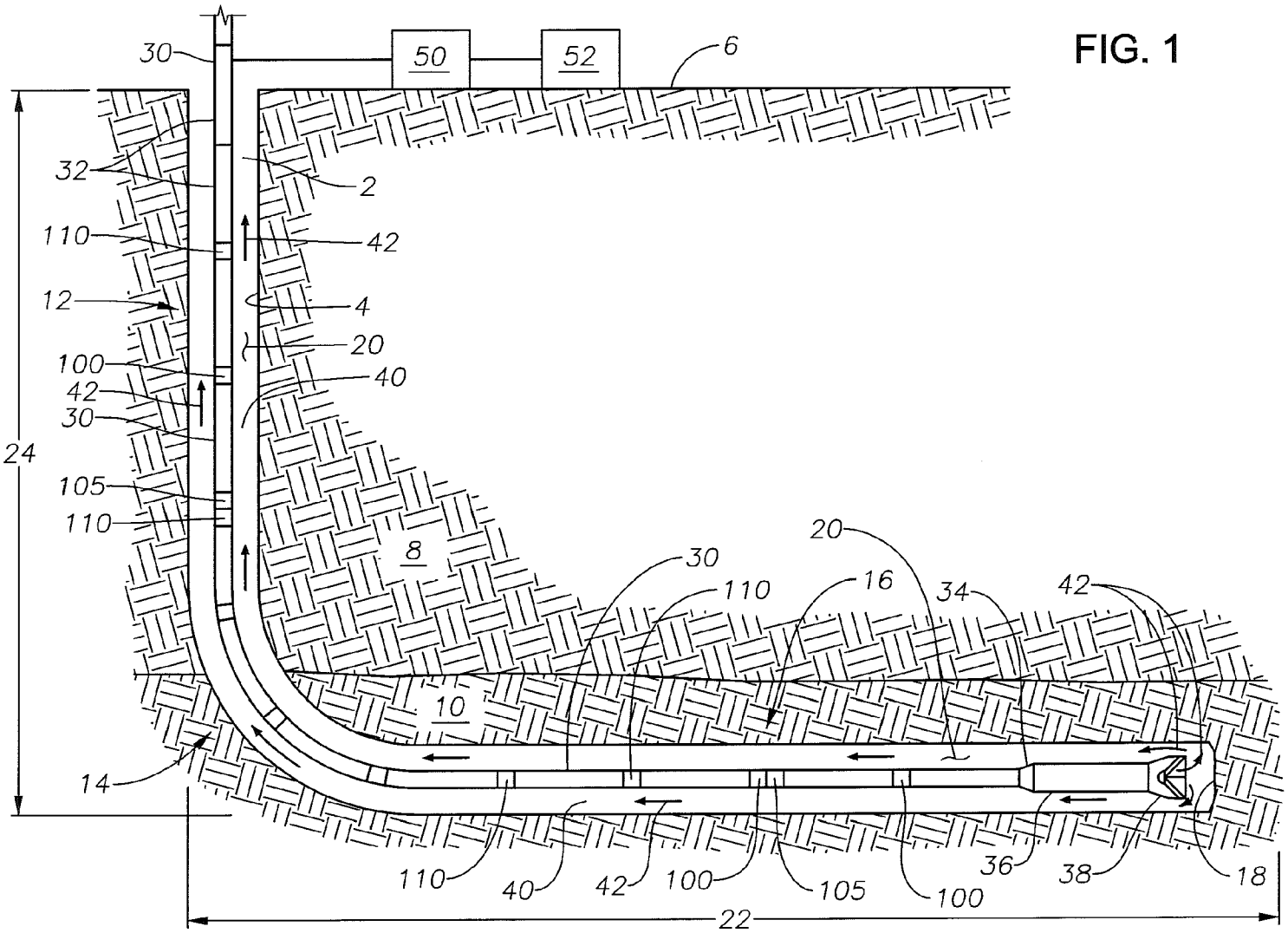
FIG. 1 is a general schematic of an embodiment of the dynamically controlled drill string in a well bore.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms “a”, “an”, and “the” include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where a range of values is provided in the Specification or in the appended Claims, it is understood that the interval encompasses each intervening value between the upper limit and the lower limit as well as the upper limit and the lower limit. The invention encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

The "inclination angle" of a well bore is the measure of deviation in angle from true vertical from the perspective of traversing downward through the well bore from the surface. An angle of 0° degree downward is "true vertical". An angle of 90° from true vertical is "true horizontal". A "horizontal run", "leg", or "section" is a portion of the well bore where the inclination angle of the well bore is equal to or greater than 65° from true vertical, including values above true horizontal up to 115° from true vertical. A "horizontal well" is a well that has a well bore with a horizontal run for a portion of the well bore length. Horizontal wells have other portions of the well bore that are less than 65° in angle, including the vertical run that connects the well bore with the surface through the surface entry point.

The "well bore length" is the length of the fluid flow pathway, representing the long dimension of the well bore versus its diameter or width, internal to the well bore from the surface entry point to the face of the well bore. An "extended reach well" (ERW) is defined as a horizontal well having a well bore length along the horizontal run at least twice as long as the true vertical depth (TVD) of the well bore.

A "multilateral" well is a well bore with branches from a single fluid pathway to the surface in the hydrocarbon-bearing formation. A multilateral well is capable of producing hydrocarbon fluids through at least two different flow pathways simultaneously. A horizontal well drilled through a single hydrocarbon-bearing zone (or "payzone") along a horizontal plane that has several fluid flow paths that fan out from a centralized vertical run is an example of a multilateral well. A multi-tier well is a well bore with well branches or runs at different vertical depths, including a well having a first horizontal run along a first hydrocarbon-bearing zone at a first depth and a second horizontal run along a second hydrocarbon-bearing zone at a second vertical depth. Multilateral and multi-tiered well bores technically have a well bore length along each variation of fluid flow pathway between each well bore face and the surface entry point; however, the well bore length usually defines the longest fluid flow pathway or the pathway where lengthening is occurring.

A "downhole condition" refers to a detectable condition in the well bore at a specific location in the well bore or along the drill string at a specific increment of time. "Distributed measurement" refers to the detection of the condition from at least two different locations along the length of a drill string. The terms "distributed measurement dataset" and "distributed measurement data" refer to the set of aggregated data of downhole condition data, which is useful for determining historical downhole conditions and borehole conditions.

A "borehole condition" refers to a calculated or predicted condition of or in the well bore or along the drill string which is not directly detectable by measurement as a downhole conditions. Manual calculations, "rules of thumb", engineering experience and pre-programmed algorithms can determine borehole conditions using distributed measurement data.

FIG. 1

FIG. 1 is a general schematic of an embodiment of the dynamically controlled drill string in a horizontal well bore.

FIG. 1 is a useful reference to describes general aspects a horizontal well and a drill string. Well bore 2 is a space defined by well bore wall 4. Well bore 2 forms a fluid pathway that extends from surface 6, through non-hydrocarbon bearing formation 8 and into hydrocarbon-bearing formation 10. Well bore 2 has several sections, including vertical run 12, transition zone 14, and horizontal run 16. Horizontal run 16 extends in a generally horizontal direction from transition zone 14 until reaching the distal end of well bore 2, which is well bore face 18. Well bore 2 contains well bore fluid 20. Well bore 2 has a horizontal run length 22 that is much longer than its total vertical depth (TVD) 24. Both horizontal run length 22 and TVD 24 are useful for determining the operative length of well bore 2.

FIG. 1 also shows dynamically controlled drill string 30 present in well bore 2. Dynamically controlled drill string 30 mainly includes drill pipe 32 coupled together by pipe threads in series. Proximate to well bore face 18, dynamically controlled drill string 30 also includes bottomhole assembly (BHA) connector 34, BHA 36 and drill bit 38. Connectors are also referred to as "subs" because they are much shorter—only a few feet in length—than drill pipe and collars. BHA 36 can contain downhole motors, rotary steerable systems, jars, stabilizers, measurement while drilling (MWD) and logging while drilling (LWD) tools and sensors.

Dynamically controlled drill string 30 has an internal fluid conduit (not shown) that permits fluid communication between surface 6 and well bore 2. The internal fluid conduit of dynamically controlled drill string 30 is accessible at drill bit 38. The exterior surface of dynamically controlled drill string 30 and well bore wall 4 define well bore annulus 40. Well bore fluid 20 circulates from the surface downhole through the internal fluid conduit of dynamically controlled drill string 30 and returns uphole (arrows 42) to the surface through well bore annulus 40 uphole.

FIG. 1 also shows dynamically controlled drill string 30 coupling to wireless telemetry system 50. Operator monitoring system 52 is in two-way signal communication with dynamically controlled drill string 30 through wireless telemetry system 50. Operator monitoring system 52 receives downhole condition data through wireless telemetry system 50 for human or computer interpretation, including conversion into borehole condition data. Wireless telemetry system 50 provides the communication interface for receiving downhole condition information and transmitting pre-designated command signals to tools and equipment in well bore 2, including those on BHA 36 and along the length of dynamically controlled drill string 30.

FIG. 1 shows that dynamically controlled drill string 30 includes measurement sub 100, circulation sub 105 and communications sub 110 along its operable length.

FIG. 2

FIG. 2 is a general schematic of a portion of an embodiment of the dynamically controlled drill string in a horizontal section of the well bore.

Figure 2A:
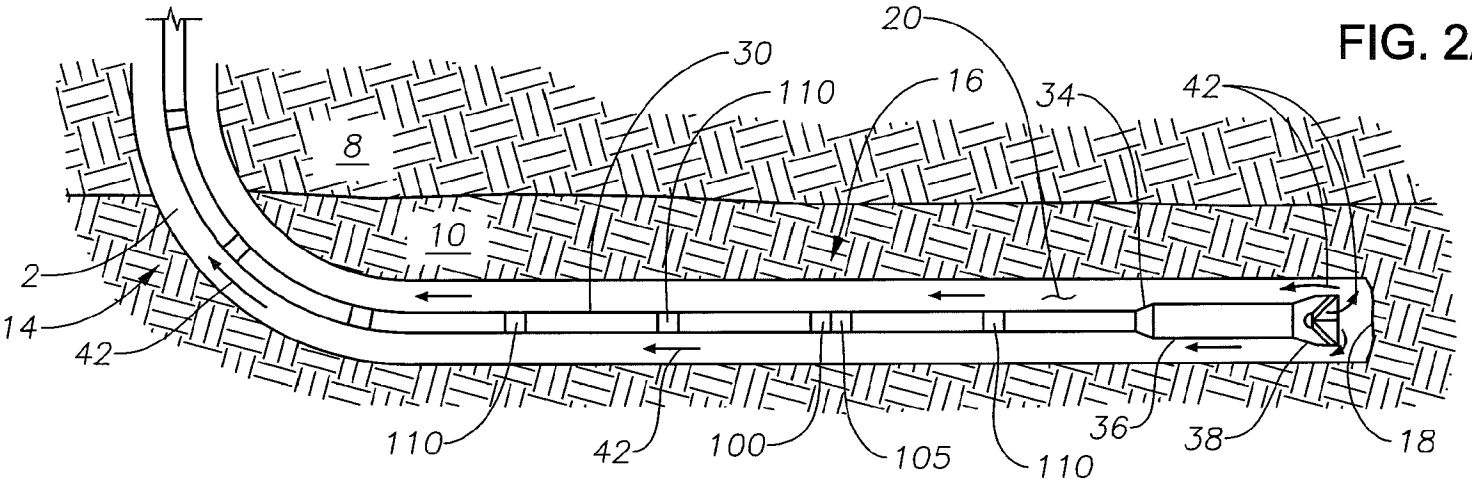
FIG. 2A-E is a general schematic of a portion of an embodiment of the dynamically controlled drill string in a horizontal section of the well bore.

FIG. 2A shows a portion of dynamically controlled drill string 30 introduced into horizontal run 16 of well bore 2 similar to the view shown in FIG. 1. Dynamically controlled drill string 30 includes measurement sub 100, circulation sub 105 and communications sub 110.

Figure 2B:
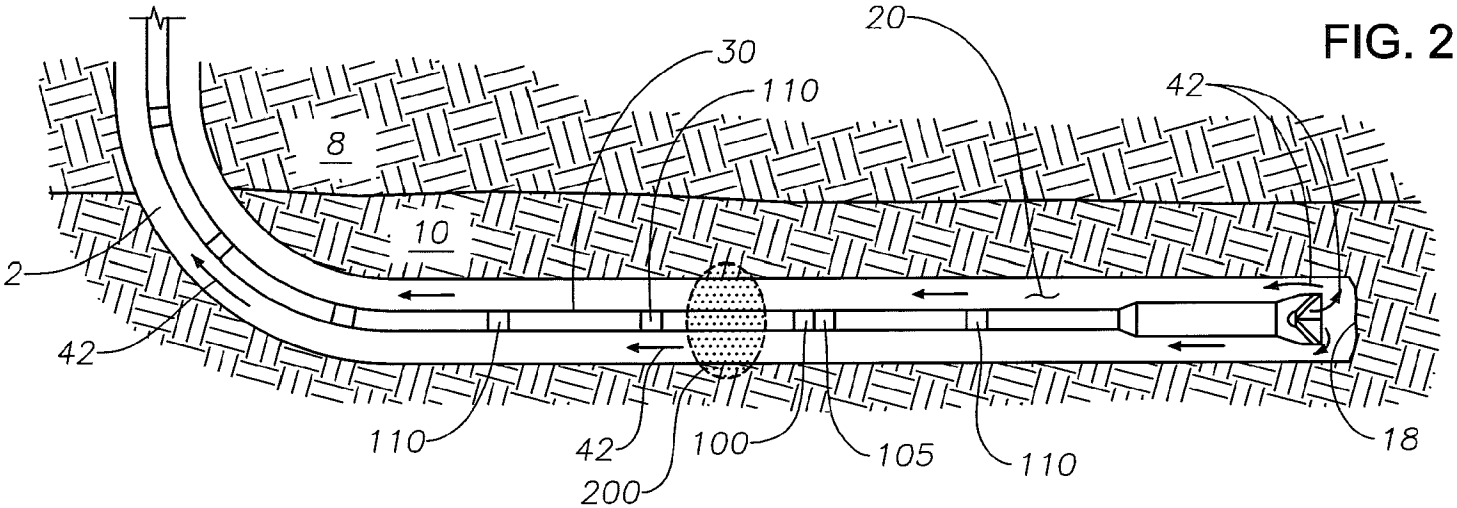

FIG. 2B shows anomaly 200 affecting an area of well bore 2. Anomaly 200 can represent a number of downhole or borehole conditions, including a kick, extreme friction on the drill string, a buckling of the drill string or a loss of well bore fluid circulation. Anomaly 200 produces a number of detectable downhole conditions, including out-of-tolerance or changes to well bore fluid temperature, well bore fluid pressure, annular flow rate and well bore fluid density. Because of its location, measurement sub 100 detects downhole conditions associated with anomaly 200.

Figure 2C:
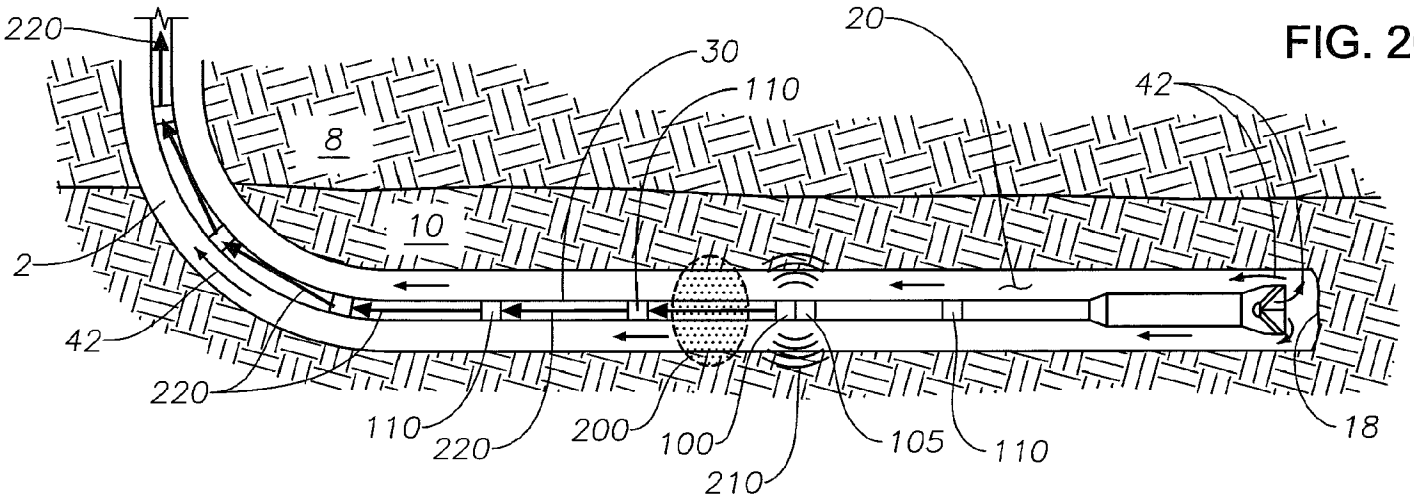

FIG. 2C shows measurement sub 100 wirelessly transmitting (outbound ellipses 210) a data signal associated with detected downhole conditions of anomaly 200. Communication subs 110 receive and retransmit the data signal wirelessly uphole (arrows 220) to wireless telemetry system and monitoring systems on the surface (not shown).

Figure 2D:
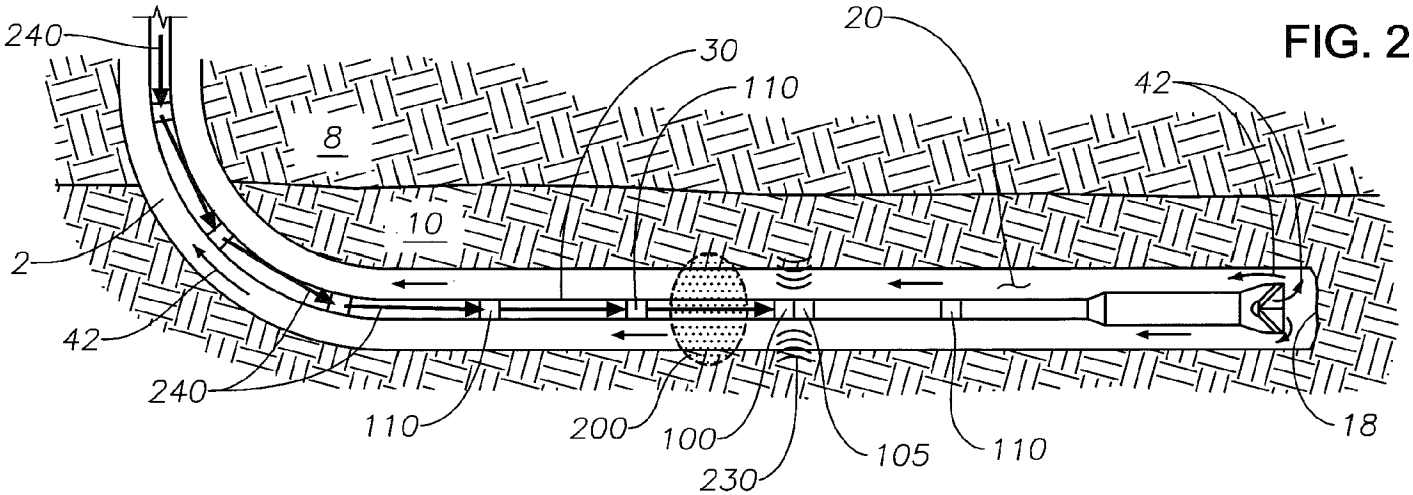

FIG. 2D shows circulation sub 105 receiving wirelessly (inbound ellipses 230) a pre-designated command signal. Communication subs 110 receive and retransmit wirelessly the pre-designated command signal downhole (arrows 240) from the wireless telemetry system at the surface (not shown) to circulation sub 105 just downhole of anomaly 200.

Figure 2E:
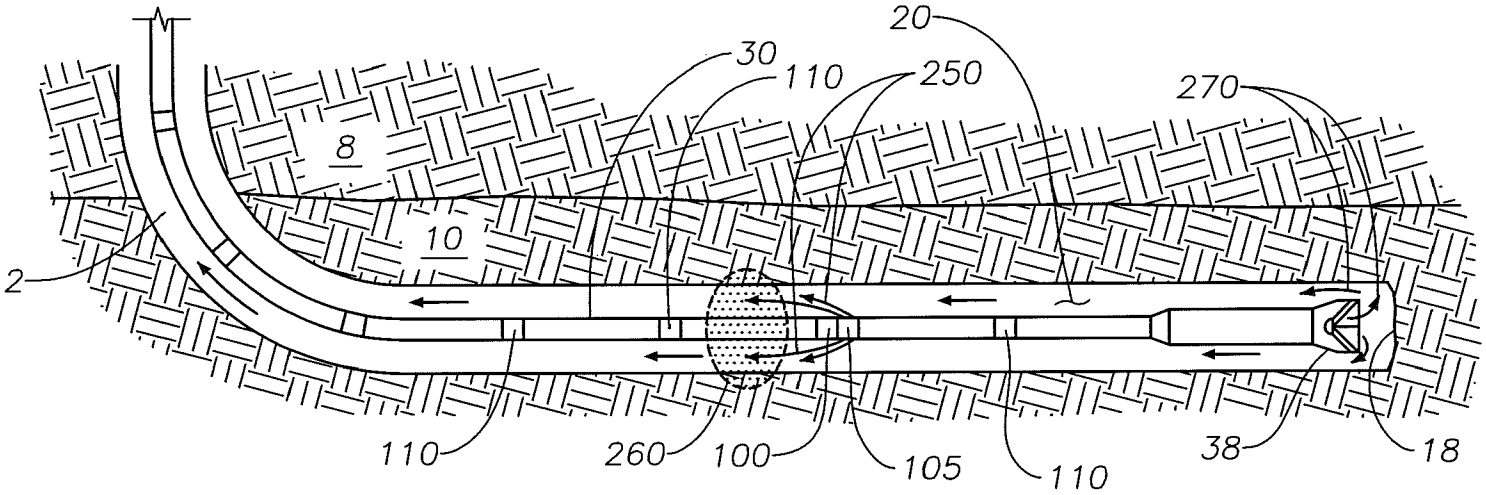

FIG. 2E shows that the pre-designated command signal causes circulation sub 105 to open fluid ports between the internal fluid conduit of dynamically controlled drill string 30 and well bore annulus 40, which diverts (arrows 250) a portion of well bore fluid 20 flowing through the internal fluid conduit into well bore annulus 40 at circulation sub 105, which is located just downhole of anomaly 200.

The redirection of a portion of the flow (arrows 250) of well bore fluid 20 changes the circulation of well bore fluid 20 in well bore 2, which transforms the conditions in well bore 2 enough to convert anomaly 200 into mitigated anomaly 260. The remaining portion of the well bore fluid 20 flowing through the internal fluid conduit of dynamically controlled drill string 30 passes from dynamically controlled drill string 30 at drill bit 38 (arrows 270). The remaining well bore fluid flow (arrows 270) helps to maintain well bore control and prevent solids from settling in well bore 2 downhole of mitigated anomaly 260.

Although not shown in detail, measurement sub 100 continues detection of downhole conditions and wireless transmission uphole of data signals regarding downhole conditions, including anomaly 200 and mitigated anomaly 260. Communications subs 110 continue to relay data signals and pre-designated command signals uphole and downhole, respectively, between the surface and systems downhole.

Surface Control and Wireless Telemetry

A surface monitoring and control system acts as an interface between the operator and the subs that are operable to receive pre-designated command signals. The surface monitoring and control system permits the operator to designate actions for the subs to take in the form of operator instructions. The surface system converts operator instructions into pre-designated commands for execution by the subs.

The surface monitoring system passes the pre-designated command to a wireless telemetry system for transmission into the well bore. The wireless telemetry system converts the pre-designated command into a wireless pre-designated command signal and transmits the signal into the well bore such that the communications, measurement and circulation subs receive and act upon the command signal.

The surface monitoring and control system is in two-way data communications with the wireless telemetry system. The wireless telemetry system operates to receive the pre-designated command from the surface monitoring and control system, convert the pre-designated command into pre-designated command signal, modulate the command signal for the intended recipient device, and transmit wirelessly the pre-designated command signal downhole.

The two systems work the other way upon receiving a signal from a device in the well bore. The wireless telemetry controller is operable to receive the data or the status signal conveyed from the sub downhole, convert the signal into data, and pass the downhole condition data to the surface monitoring and control system for automated or manual processing, or both. The surface monitoring and control system, in turn, displays information related to the received downhole conditions, calculates borehole conditions, and display them in a human-interpretable manner.

Several known telemetry techniques are useful for transmitting wireless signals between the surface and the communications, circulation and measurement subs, including electromagnetic (EM) telemetry and acoustic telemetry. EM and acoustic telemetries through the dynamically controlled drill string are preferred, and solid acoustic telemetry is most preferred.

Different wireless telemetry systems used in coordination with one another are useful as transmission methods for conveying wireless data, status and pre-designated command signals uphole and downhole. For example, an acoustic telemetry system can transmit pre-designated command signals from the surface into the well bore while an EM telemetry system transmits a second, parallel signal downhole. In another example, a wireless telemetry system can transmit pre-designated command signals via solid acoustic telemetry downhole while subs can transmit data and status signals uphole using EM telemetry.

Dynamically Controlled Drill String

The dynamically controlled drill string includes at least one communications sub, at least one measurement sub and at least one circulation sub.

The communications, measurement and circulation subs of the dynamically controlled drill string are operable to receive wireless pre-designated command signals. Upon receiving the wireless pre-designated command signal, the receiving sub correlates the instructions contained in the pre-designated command signal with an associated function. The sub operates to perform the necessary steps to execute the function upon making the association. For example, a pre-designated command signal received by a communication sub addresses a communication sub to retransmit the received pre-designated command signal wirelessly downhole for a device located downstring. The same pre-designated command signal can instruct a circulation sub to restrict flow in the internal fluid conduit of the drill string for a designated period and establish choked flow between the internal fluid conduit and the well bore annulus.

Only the capabilities of the sub and the instructions received limits the number and type of operations performed upon receipt of a pre-designed command signal. For example, a transmitted pre-designated command signal can instruct one or more subs to enter a non-dormant or "operational readiness" state; other pre-designed command signals can instruct subs to power down. Pre-designed command signals can request operational status information from one or more subs or transmit previously collected data uphole. Pre-designated command signals can instruct several subs that operate independently of one another to act in concert in executing a series of pre-designed command signals.

In instances where a device transmits a pre-designated command signal as a modulated, compressed or encoded signal, the receiving device is operable to demodulate, decompress or decode the wireless signal, as necessary.

The position of the sub can be anywhere along the operative length of the dynamically controlled drill string—coupling drill pipes, drill collars and downhole tools to one another. The configuration of the sub can connect different types of drill string components. The sub can be proximate to or couple with a different type of sub. Each sub has an interior fluid conduit and an exterior surface similar to the rest of the dynamically controlled drill string.

Communications Sub

The dynamically controlled drill string has at least one communication sub operable to receive a wireless signal and retransmit the received signal wirelessly in the appropriate direction along the dynamically controlled drill string. The communications sub is operable to receive from the surface pre-designated command signals and retransmit the command signals downhole. The communications sub is also operable to receive data signals and status signals from subs and devices located downhole and retransmit the signals uphole.

The relative spacing between multiple communications subs in the dynamically controlled drill string depends on the wireless telemetry method used for relaying signals. It is not desirable to permit the wireless signals to degrade too much in strength before retransmitting the wireless signal. An embodiment of the dynamically controlled drill string includes where the distance between communications subs along the operative length of the dynamically controlled drill string is such that a single inoperable communications sub does not render the wireless telemetry system inoperable.

The type of wireless signal reception and retransmission depends on the type of wireless telemetry system employed. An embodiment of the dynamically controlled drill string includes a communication sub operable to receive more than one type of wireless telemetry signal. An embodiment of the dynamically controlled drill string includes a communication sub operable to receive a wireless signal in one form telemetry and retransmit the wireless signal using a different form of wireless telemetry. An example includes a communications sub operable to receive a wireless signal using EM telemetry and operable to transmit a wireless signal using solid acoustic telemetry.

Each communications sub acts as a signal relay in a wireless signal path between the wireless telemetry system on the surface and well bore devices and subs. An embodiment of the dynamically controlled drill string includes a communication sub that is operable to receive a wireless signal, determine the device the signal is intended for based upon its position along the operable length of the dynamically controlled drill string, and selectively not retransmit the signal based upon the relative position of the receiving communication sub to the intended device along the dynamically controlled drill string. A wireless signal bearing an address or location code to signal a particular sub or device can indicate to a communications sub whether the communication sub should relay the signal either uphole or downhole. With such a communication sub, if the pre-designated command signal is not for a device downhole of its position or if a device downhole of its position does not generate the status or data signal, the communication sub does not retransmit the signal. Selectively not retransmitting wireless signals not intended for tools downhole of the communication sub not only preserves battery power but also prevents unintentional activation/deactivation of other tools.

An embodiment of the dynamically controlled drill string includes a communication sub that is operable to receive a wireless signal and retransmit the wireless signal at higher signal strength than received. Some signal attenuation is inevitable over long distances, especially with confounding noise due to operations. The communication sub gives the signal more power to traverse the distance between the communication sub and the next signal receiver. An embodiment of the dynamically controlled drill string includes a communication sub that retransmits pre-designated command signals at a higher signal strength than received.

Measurement Sub

The dynamically controlled drill string has at least one measurement sub. An embodiment of the dynamically controlled drill string has more than one measurement sub. An embodiment of the dynamically controlled drill string has a measurement sub operable to detect more than one downhole condition.

The measurement sub is operable to form a data signal associated with the detected downhole condition and transmit the downhole condition-based data as a wireless signal towards the surface. In conjunction with the communication sub, the wireless data signal traverses the well bore until reaching the wireless telemetry system at the surface.

The measurement sub can detect downhole conditions and then transmit wireless data signals in a continuous, non-continuous, periodic or other manner. An embodiment of the dynamically controlled drills string includes a measurement sub that provides downhole condition data only in response to a specific pre-designated command signal. Wireless transmission to the surface of data can be coordinated with drill string operations, including by depth or by regular time interval.

Configurations of the measurement sub can facilitate detection of a variety of downhole conditions. The number and type of sensors include sensors for detecting conditions affecting the drill string, the fluids inside or outside the drill string, the well bore, the formation and fluids in the formation. Detectable downhole conditions include actual drilling performance, well bore characteristics, drill string assembly profile and formation information. Examples of drilling performance conditions include fluid circulation fluid flow rate, pressure and temperature through both inside the drill string and the annulus; rotation speed (RPM) of the drill bit and the mud motor; weight on the bit ("WOB"); torque of the bit; vibrations; and pressure differential across the mud motor. Example well bore conditions include information for both the fluid in the well bore and the well bore itself, including downhole, operating, and annular temperatures, pressures, and fluid flow rates; gas content, pH, density, viscosity, fluorescence, radioactivity, solids content, clarity, and compressibility of the well bore fluid; actual bore hole size and shape, inclination, azimuth, depth, resistivity/conductivity, porosity, and wall temperature of the well bore. Example drill string assembly profile conditions include tri-axial stress load, drill string stress, internal and external hydraulic fluid pressures, torque and tension/compression, whirl detection, string strain, inclinometers, magnetometers, accelerometers, bending, and vibration. Examples of formation conditions includes resistivity, dielectric constant, neutron porosity, rock neutron density, permeability, acoustic velocity, natural gamma ray, formation pressure, fluid mobility, fluid composition, rock matrix composition, magnetic resonance imaging of formation fluids, rock sonic strength and gravimeters. Those of ordinary skill in the art understand that many of the downhole conditions given overlap and, as such, are only illustrative. Other detectable downhole conditions not included are not excluded as useful downhole conditions for operations monitoring.

The measurement sub is operable to receive and act upon a pre-designated command signal. The measurement sub processes and operates based upon the received wireless signals separately and in the order received.

The detection of a downhole condition using multiple measurement subs can help construct a distributed measurement dataset. In an embodiment of a dynamically controlled drill string with more than one measurement sub, the multiple measurement subs are operable to detect the same type of downhole condition simultaneously. In an embodiment of a dynamically controlled drill string with more than one measurement sub, multiple measurement subs are also operable to detect the same downhole condition in temporal series. A drill string with measurement subs tripping a well bore can detect the same downhole condition with different measurement subs at different times. While tripping the dynamically controlled drill string, a first measurement sub detects a condition at a first specific time and then a second measurement sub detects the same condition at a second specific time. The data can support determining changes to the condition at the specific location as well as determine changes to borehole conditions.

Circulation Sub

The dynamically controlled drill string has at least one circulation sub operable to selectively introduce fluid into the well bore annulus. An embodiment of the dynamically controlled drill string has a circulation sub operable to selectively permit fluid flow though the internal fluid conduit of the dynamically controlled drill string.

An embodiment of the dynamically controlled drill string has more than one circulation sub located along its operative length. The location of each circulation sub can control the positions of the drill string in the well bore. The location can also control where treatment occurs for portions of the well bore annulus, casing, the well bore wall and the formation.

Each circulation sub is operable to selectively permit fluid communication between the interior fluid conduit and the external environment of the dynamically controlled drill string at the circulation sub. An annular flow control valve provides selective fluid communication through the body of the circulation sub. In instances where the circulation sub has more than one annular flow control valve, it is preferable that each annular flow control valve is separately selectively operable. The position of each annular flow control valve on a circulation sub can be proximate or distant relative to one another.

Optionally, the circulation sub is operable to selectively permit fluid to pass through the drill string interior fluid conduit. A drill string flow control valve provides selective fluid communication through the drill string interior fluid conduit between the surface and the well bore interior.

The circulation sub is operable to receive and act upon a pre-designated command signal. The circulation sub processes and operates based upon the received wireless signals separately and in the order received. For example, the circulation sub can receive a pre-designated command signal associated with verifying its status, including the position of the annular flow control valve and, if present, the drill string flow control valve, and transmit a data signal in response that indicates the position of the valves.

Method of Using a Dynamically Controlled Drill String

The dynamically controlled drill string, which includes at least one communications sub, at least one measurement sub and at least one circulation sub, is useful not only for detecting a downhole condition in the well bore but also for modifying the detected condition. The introduction of a treatment fluid into the well bore proximate to the detected condition can modify the detected condition and mitigate its effects on the drill string and the well bore.

The method includes the step of introducing the dynamically controlled drill string into a pre-formed well bore, the well bore defined by a well bore wall and extending from the surface to a hydrocarbon-bearing formation. Well bore fluid fills the well bore. The introduction of the dynamically controlled drill string forms the well bore annulus between the exterior of the dynamically controlled drill string and the well bore wall.

The method includes the step of operating the dynamically controlled drill string such that at least one measurement sub detects a downhole condition. The measurement sub, in response to detecting the downhole condition, transmits a wireless data signal associated to the detected condition. Communications subs along the operative length of the dynamically controlled drill string between the surface and the measurement sub relay the wireless data condition signal to the surface wireless telemetry system. The surface wireless telemetry system receives the wireless condition signal, converts the condition signal into condition data, and passes the condition data to systems for human or computer interpretation, including processing the downhole condition data into borehole condition information, and for direct management of the dynamically controlled drill string. An embodiment of the method includes where the detected downhole condition is associated with a borehole condition.

The method includes the step of transmitting wirelessly a pre-designated command signal directed to a circulation sub. An embodiment of the method includes transmitting the pre-designated command signal in response to the detected downhole condition. The surface wireless telemetry transmits the pre-designated command signal wirelessly downhole.

The communications subs along the operative length of the dynamically controlled drill string between the surface and the circulation sub convey the wireless data condition signal to the addressed circulation sub.

Upon receiving the pre-designed command signal, the circulation sub operates to selectively permit fluid communication between the well bore annulus and the internal fluid conduit at the circulation sub. An embodiment of the method includes where the circulation sub modifies the fluid circulation flow path by permitting fluid flow between the internal fluid conduit and the well bore annulus at the circulation sub. An embodiment of the method includes where the circulation sub modifies the fluid circulation flow path by denying fluid flow between the internal fluid conduit and the well bore annulus at the circulation sub. An embodiment of the method includes where the circulation sub modifies the fluid circulation flow path by permitting fluid flow between the internal fluid conduit and the well bore annulus at the circulation sub such that the volumetric fluid flow is "throttled" or "choked" at the circulation sub. Maximized fluid flow through a partially opened valve is described colloquially as "throttled" or "choked" fluid flow.

Selectively opening annular flow control valves can significantly modify the downhole conditions in the well bore annulus proximate to the circulation sub. By opening at least one annular flow valve, a fluid flow path forms that directs at least a portion of the fluid flowing through the interior of the drill string into the well bore fluid in the well bore annulus at the circulation sub. Differential pressure at the circulation sub between the interior fluid conduit and the well bore annulus drives fluid flow through the opened annular flow control valve. The portion of fluid entering the well bore annulus at the circulation sub returns to the surface with the rest of the well bore fluid flowing through the well bore annulus. The remainder of the fluid in the interior fluid conduit traverses the operative length of the dynamically controlled drills string, passes into the well bore at the end of the drill string, and returns to the surface as part of the well bore fluid in the well bore annulus.

Coordination of the position of annular flow control valves selective operations, including treatment of one side of the well bore and lifting of the dynamically controlled drill string from the well bore wall.

If the circulation sub has an optional drill string flow control valve, upon receiving the pre-designed command signal the circulation sub operates to selectively permit or deny fluid communication along the internal fluid conduit at the circulation sub. An embodiment of the method includes where the circulation sub modifies the fluid flow path by permitting fluid communication along the interior fluid conduit. An embodiment of the method includes where the circulation sub modifies the fluid flow path by permitting fluid communication along the interior fluid conduit such that volumetric fluid flow along the internal fluid conduit is "throttled" or "choked" at the circulation sub. An embodiment of the method includes where the circulation sub modifies the fluid flow path by denying fluid communication along the internal fluid conduit at the circulation sub.

In methods of detecting and treating conditions in a well bore where the dynamically controlled drill string has a circulation sub with a drill string flow control valve, coordinating the position of the annular flow control valve and the drill string flow control valve at a specific circulation sub can at least partially direct, if not completely direct, the fluid flow from the internal fluid conduit into the well bore annulus at the circulation sub to treat the detected condition. Selective positioning of the annular flow control valve such that it is at least partially open while the drill string fluid conduit flow control valve is fully closed introduces fluid into the well bore annulus at the circulation sub. A partially opened drill string fluid conduit flow control valve permits some of the fluid flowing through the internal fluid conduit to continue downhole along the interior fluid conduit.

To halt flow completely in the well bore, a pre-determined command signal can shut all of the flow control valves in an immediate or controlled and sequential manner, depending on design and programming. The design of the final valve to close can resist abrasive and high-pressure differential flow.

The method of treatment includes introducing a treatment fluid into the well bore to treat the detected condition. An embodiment of the method includes introducing the treatment fluid into the well bore such that the treatment fluid flows downhole through the interior fluid conduit of the dynamically controlled drill string, into the well bore annulus at the circulation sub, and uphole through the well bore annulus to the location of the detected condition. Well bore fluid displaced upon introduction of the treatment fluid flows to the surface through the well bore annulus. An embodiment of the method includes introducing the treatment fluid into the well bore such that the treatment fluid flows downhole through the well bore annulus to the location of the detected condition. Well bore fluid displaced upon introduction of the treatment fluid flows to the surface through the interior fluid conduit, entering the dynamically controlled drill string at the circulation sub permitting fluid connectivity between the well bore annulus and the interior fluid conduit.

The treatment fluid introduced into the well bore includes water or oil-based drilling fluid or mud, cements, aqueous acid or enzyme treatments, seawater, fresh water and spacer fluids. The treatment fluid can have different properties than the well bore fluid, including density, composition, temperature and dissolved gases. The treatment fluid treats the detected condition upon contact.

Well control and well treatment advantages are possible by coordinating the selective positions of circulation sub control valves between more than one circulation sub. Positioning a set of annular flow control valves and the drill string flow control valve on an upstring circulation sub such that a portion of the fluid flowing through the interior fluid conduit passes through the annular flow control valves of the uphole circulation sub permits the remainder of the fluid to pass into the well bore annulus through a downhole circulation sub. At the downhole circulation sub, closing the drill string flow control valve maximizes flow through both sets of annular flow control valves.

The dynamically controlled drill string can not only detect an unexpected influx of hydrocarbons into the well bore but also provide the means for circulating out kick-contaminated fluids from the well bore. Multiple measurement subs can detect downhole conditions indicative to an intrusion of gas or petroleum liquids that are not similar to the well bore fluid. After halting well bore fluid circulation and isolating the well, a circulation sub is useful for slowly reintroducing fluid flow by opening an annular flow control valve as a system choke valve to regulate flow out of the isolated well bore. Measurement subs provide updates to downhole conditions along the operative length of the dynamically controlled drill string to indicate the progression of the kick and the effectiveness of mitigation efforts. Communications subs provide command and data signals while the well bore fluid is virtually static.

The operator can establish flow out of the well through an annular flow control valve or drill string flow control valve, or both. To halt flow completely in the well bore, the operator can transmit a pre-determined command signal to shut all of the flow control valves in a sequential and controlled manner. The final valve closing flow from the well bore can be a valve designed to resist damage across an abrasive and high-pressure differential flow.

To kill the well, the operator can circulate fluid from the well bore using the drill string not only to move the influx-containing well bore fluid through the drill string to the surface but also by choking the flow to the surface, creating sufficient back pressure to limit additional hydrocarbon influx. The operator can create a fluid flow pathway to the surface though the drill string by partially opening combinations of circulation sub valves. The operator can command the circulation sub downhole of the location of the well bore influx to at least partially open control valves to create a fluid flow pathway between the well bore annulus and the drill string internal fluid conduit. Opening at least partially the circulation sub flow control valves upstring of the previously referred circulation sub establishes the fluid flow pathway from the circulation sub to the surface.

Introducing a fluid with different chemical or physical properties—usually denser than the fluid in the well bore—directly into the well bore annulus both induces fluid flow in the well bore and suppresses further hydrocarbon influxes into the well bore. Introduction of the heavier fluid into the well bore annulus and the opening of the flow control valves in the drill string induces circulation of the contaminated well fluid. As the hydrocarbon-contaminated drilling fluid slowly circulates out, the heavier drilling mud puts sufficient hydraulic pressure on the formation to prevent continued influx. Circulation subs can function as system chokes restricting the fluid flow through the drill string as well as by maintaining backpressure on the well bore to prevent additional influx. The non-contaminated heavier fluid eventually circulates through the entire well bore, removing the hydrocarbon influx materials.

What is claimed is:

1. A method for modifying a detected anomaly in a well bore using a dynamically controlled drill string comprising the steps of:

introducing the dynamically controlled drill string into the well bore such that a well bore annulus forms between an external surface of the dynamically controlled drill string and a wall of the well bore, where the dynamically controlled drill string includes communications subs, measurement subs and circulation subs along its operable length, has an internal fluid conduit and the external surface for its operative length and has an open distal end that is operable to pass fluid between the internal fluid conduit and the well bore, where the circulation sub is operable to selectively modify a fluid circulation flow path for a fluid in the well bore upon receiving of a pre-designated command signal, and where the well bore is defined by the well bore wall that extends from a surface into a hydrocarbon-bearing formation and contains the fluid;

inducing circulation of the fluid in the well bore such that the fluid circulates along a first fluid circulation flow path that extends through the dynamically controlled drill string, a drill bit on an end of the drilling string, and the well bore annulus;

operating the dynamically controlled drill string such that a one of the measurement subs detects an anomaly adjacent the a one of the measurement subs and transmits wirelessly upstring a corresponding data signal associated with the detected anomaly;

operating the dynamically controlled drill string such that the communication sub receives wirelessly the data signal from the measurement sub and retransmits the data signal wirelessly upstring, where the communication sub is located upstring of the measurement sub;

transmitting wirelessly downhole to the circulation sub a pre-designated command signal associated with modifying the fluid circulation flow path from the first fluid circulation flow path to a second fluid circulation flow path, where the second fluid circulation flow path directs fluid towards the detected anomaly;

operating the dynamically controlled drill string such that the communication sub receives wirelessly the pre-designated command signal from upstring and retransmits the pre-designated command signal wirelessly downstring, where the communication sub is located upstring of the circulation sub; and introducing a modifying fluid from a port in a one of the circulation subs that is adjacent the anomaly, and that is operable to modify the detected anomaly in the well bore such that the modifying fluid circulates in the well bore along the second fluid circulation flow path fluid and rectifies the anomaly, wherein the modifying fluid comprises the fluid that has been diverted from within the dynamically controlled drill string and that would otherwise flow to the drill bit.

2. The method of claim 1 where the well bore is a horizontal well.

3. The method of claim 1 where the anomaly detected and rectified is associated with a blockage of well bore annulus fluid circulation.

4. The method of claim 1 where the anomaly detected is associated with an uncontrolled influx of hydrocarbons.

5. The method of claim 1 where the anomaly detected and rectified is associated with an increase in drill string friction.

6. The method of claim 1 where the anomaly detected is associated with a stuck drill string, and wherein directing the modifying fluid from the circulation sub frees the stuck drill string from the wellbore to define a mitigated anomaly.

7. The method of claim 1 where the communications sub receives the wireless signal using a first form of wireless telemetry and retransmits the signal wirelessly using a second form of wireless telemetry.

8. The method of claim 1 where the circulation sub modifies the fluid circulation flow path by permitting fluid flow between the internal fluid conduit and the well bore annulus at the circulation sub.

9. The method of claim 1 where the circulation sub modifies the fluid circulation flow path by permitting throttled fluid flow between the internal fluid conduit and the well bore annulus at the circulation sub and blocking flow through the internal fluid conduit to the drill bit.

10. The method of claim 1 where the circulation sub modifies the fluid circulation flow path by denying fluid flow between the internal fluid conduit and the well bore annulus at the circulation sub.

11. The method of claim 1 where the circulation sub modifies the fluid circulation flow path by permitting fluid flow through the internal fluid conduit at the circulation sub.

12. The method of claim 1 where the circulation sub modifies the fluid circulation flow path by permitting throttled fluid flow through the port.

13. The method of claim 1 where the circulation sub modifies the fluid circulation flow path by denying fluid flow through the internal fluid conduit at the circulation sub.

14. The method of claim 1 where one fluid circulation flow path passes through the circulation sub between the internal fluid conduit and the well bore annulus and other fluid circulation flow path does not.

15. The method of claim 1 where one fluid circulation flow path passes through the circulation sub along the internal fluid conduit and the other fluid circulation flow path does not.

16. The method of claim 1, further comprising creating a wireless signal having an address indicating a destination communications sub and transmitting the wireless signal to the destination communications sub, so that when the destination communication sub is spaced uphole from a lowei lost communications sub, the wireless signal terminates at the destination communications sub.

17. The method of claim 1 where the step of transmitting wirelessly downhole comprises transmitting wirelessly downhole to a first circulation sub and a second circulation sub a pre-designated command signal associated with modifying the fluid circulation flow path from the first fluid circulation flow path to a second fluid circulation flow path, where the dynamically controlled drill string comprises the first circulation sub and the second circulation sub and the first circulation sub is uphole of the second circulation sub, where the first circulation sub modifies the fluid circulation flow path by throttling fluid flowing between the internal fluid conduit and the well bore annulus and by throttling fluid flowing along the internal fluid conduit at the first circulation sub, and where the second circulation sub modifies the fluid circulation flow path by throttling fluid flowing between the internal fluid conduit and the well bore annulus and by denying fluid flow through the internal fluid conduit at the second circulation sub, where the second fluid circulation flow path directs fluid towards the detected anomaly.

* * * * *